United States Patent [19]

Landrum et al.

[11] 4,352,644

[45] Oct. 5, 1982

[54] AIR-HYDRAULIC PUMP

[75] Inventors: Michael T. Landrum, Elysian; Terrance M. Anderson, Owatonna, both of Minn.

[73] Assignee: Owatonna Tool Company, Owatonna, Minn.

[21] Appl. No.: 148,696

[22] Filed: May 12, 1980

[51] Int. Cl.[3] ..... F01L 21/04; F04B 17/00

[52] U.S. Cl. ..... 417/402; 91/224; 91/227; 91/229

[58] Field of Search ..... 91/222, 224, 225, 226, 91/227, 229; 417/401, 402

[56] References Cited

U.S. PATENT DOCUMENTS

| | | | |
|---|---|---|---|
| 2,091,390 | 8/1937 | Forman | 91/224 |
| 2,748,751 | 6/1956 | Johnson | 91/224 |
| 2,932,285 | 4/1960 | Peeps | 91/224 |
| 2,987,051 | 6/1961 | Goyette et al. | 91/224 |
| 3,597,121 | 8/1971 | McClockin | 417/400 |

FOREIGN PATENT DOCUMENTS 43-22714 9/1968 Japan .

*Primary Examiner*—Leonard E. Smith

*Attorney, Agent, or Firm*—Wegner, McCord, Wood & Dalton

[57] ABSTRACT

An air-hydraulic pump wherein an air-motor drives the pump. The air-motor includes a reciprocal piston which is driven in one direction by fluid under pressure and is returned by a spring. A control valve is utilized to control the action of fluid under pressure on the piston with the control valve having an open position which is maintained by trapped fluid pressure within a piston chamber in which the control valve is positioned. The control valve is closed by physical contact thereof with an end wall of the cylinder movably mounting the piston at the end of the return stroke and a resilient member is positioned adjacent the cylinder end wall to maintain the control valve in closed position for a portion of the piston stroke as it moves away from the cylinder end wall in the pumping stroke to avoid a possible stall condition for the motor.

2 Claims, 2 Drawing Figures

AIR-HYDRAULIC PUMP

BACKGROUND OF THE INVENTION

This invention pertains to an air-hydraulic pump having a fluid motor utilizing a reciprocal piston carrying control valve means and with structure provided to prevent inadvertent stalling of the piston of the air-motor.

An air-hydraulic pump wherein a fluid motor drives a pumping member is shown in McClocklin U.S. Pat. No. 3,597,121, owned by the assignee of this application. Pumps of this type have been in extensive use for a number of years. The air-hydraulic pump has an air-motor including a reciprocal piston which is driven in one direction by fluid under pressure and is returned by a spring. The cycling of the air-motor is under the control of control valve means movably mounted within the piston. The valve means is in open position during the return stroke of the piston to a retracted position thereof and the pumping stroke of the piston to an extended position relies upon closing of the valve means by physical contact thereof with an end wall of the cylinder mounting the piston. Normally, the piston will contact the end wall of the cylinder at the end of the return stroke and it is possible to have a rebounding action thereof which can inadvertently cause the valve means to move from closed to open position, with the result that the piston can stall, which terminates the operation of the pump.

SUMMARY OF THE INVENTION

The primary object of the invention is to provide improvements in an air-hydraulic pump of the type previously described wherein the possible stalling action of the air-motor which drives the pump is avoided.

In carrying out the foregoing, the invention resides in controlling the position of valve means associated with the piston of the air-motor whereby the valve means is prevented from moving to an open position as the piston of the air-motor initially moves away from a retracted position in the pumping stroke thereof.

More particularly, the invention resides in an air-hydraulic pump having a reciprocably-operable pumping member, a fluid motor for said pumping member including a piston reciprocable within a cylinder, valve means movably carried by said piston and having a closed position for causing application of fluid pressure to one side of said piston to cause a pumping stroke of the piston and having an open position whereby the piston can move through a return stroke, said valve means being exposed at one side of the piston for contact with means at an end wall of said cylinder as the piston in the return stroke thereof moves to a position adjacent said cylinder end wall whereby the valve means moves relative to the piston from open to closed position, and means engaging the valve means when the piston is adjacent said cylinder end wall and operable to hold the valve means closed during the initial movement of the piston away from the cylinder end wall in the pumping stroke.

DESCRIPTION OF THE PREFERRED EMBODIMENT

Figure 1:
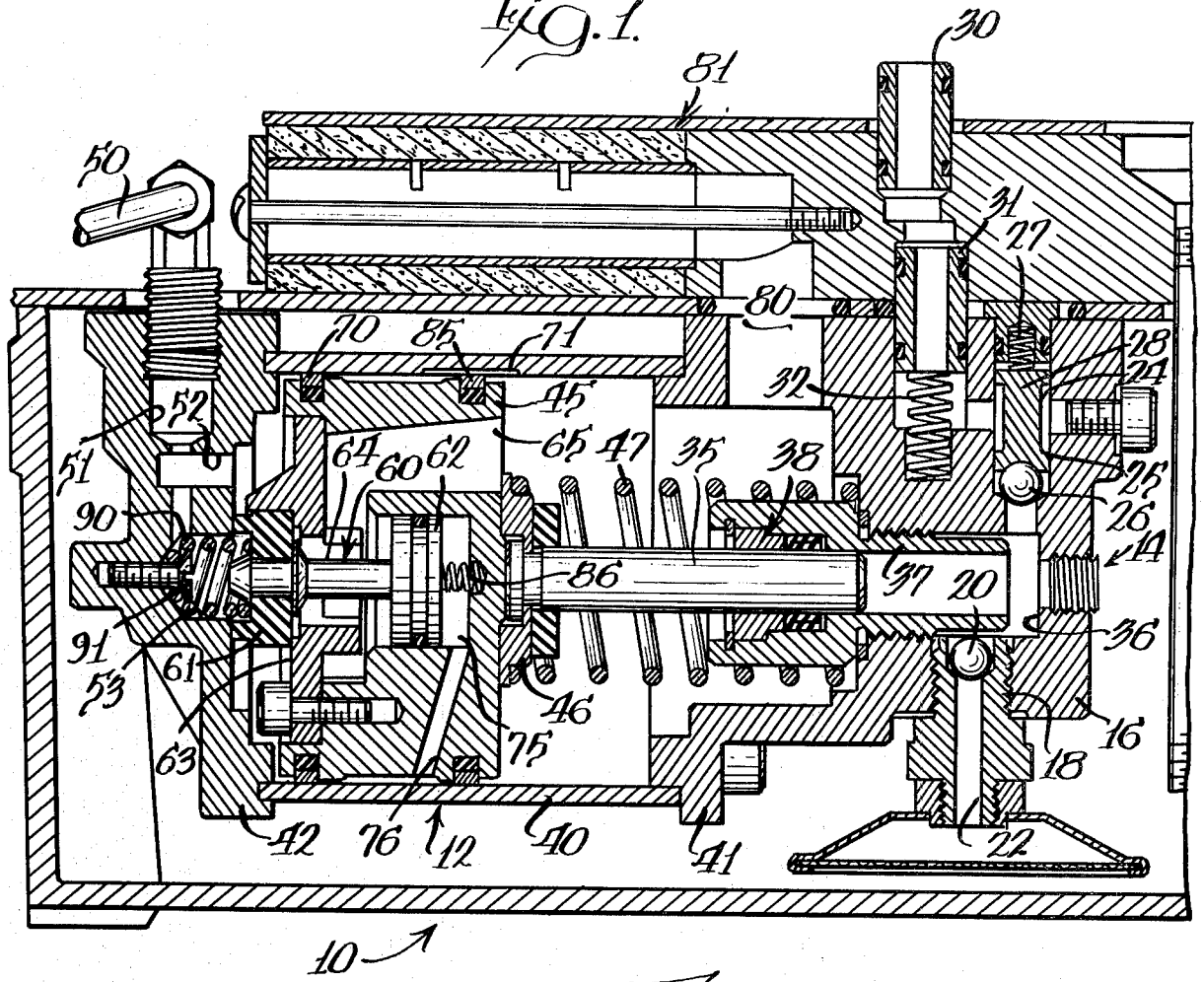
FIG. 1 is a central vertical section of an air-hydraulic pump made according to the invention, with the parts positioned at the beginning of a pumping stroke.
Figure 2:
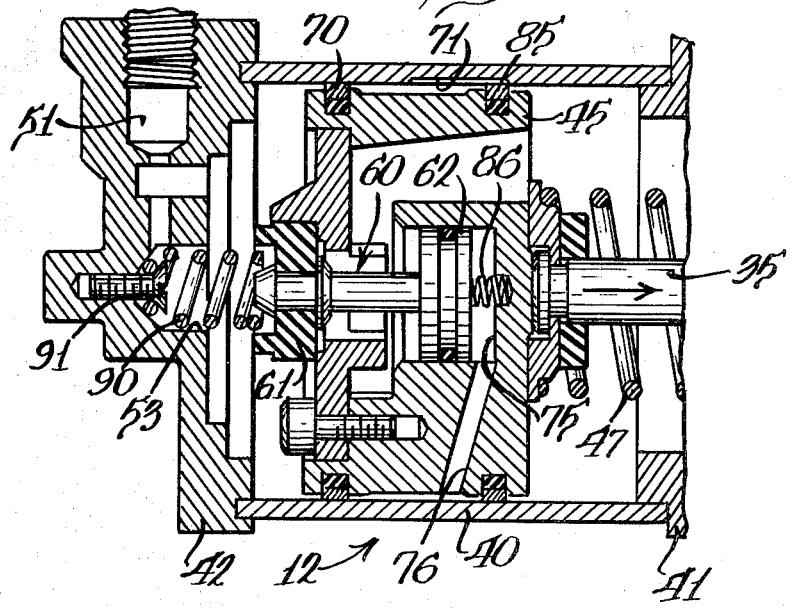
FIG. 2 is a fragmentary section, similar to FIG. 1, showing the pump after the fluid motor piston is moved a short distance in a power stroke.

The air-hydraulic pump comprises a housing, generally indicated at 10, in which a fluid motor and, more particularly, an air-motor, generally designated 12, is positioned and a hydraulic pump, generally indicated at 14. The hydraulic pump 14 has a casting 16 with a threaded bore 18 which receives a check valve, in the form of a ball valve member 20 which is operative to permit hydraulic fluid to be admitted to the pump 14 through a passage 22 from a reservoir within the housing during a return stroke of the motor 12. The ball valve member 20 is operable to preclude the passage of hydraulic fluid back to the reservoir during the pumping stroke of the motor.

The casting 16 further includes a bore 24 positioned within a passage 25 and which has a ball check valve 26 operable to permit passage of hydraulic fluid during the pumping stroke, but preventing reverse flow. The ball check 26 is urged to a closed position by a spring 27 acting through a stem 28. The stem 28 is of a square cross section and the passage 25 is cylindrical whereby fluid can flow to an outlet fitting 30 through an intermediate fitting 31 which is spring-loaded in position by a spring 32.

The pump 14 has a pumping member 35, in the form of a ram movable within a pumping chamber 36 formed in part within the casting 16 and in part by a guide member 37 threadably fitted into the casting 16 and having a cylindrical bore in which the pumping member 35 reciprocates. The guide member 37 has suitable seal structure, indicated generally at 38, for sealing off the pumping chamber from the air-motor 12.

The air-motor 12 has a cylinder formed by an annular wall 40 and end walls with one end wall being formed by an end 41 of the casting 16 and with the other end wall being identified at 42. A piston 45 is reciprocable within the cylinder and is associated with the pumping member 35 by securing means 46 and with a spring 47 acting between the casting 16 and the piston 45 urging the piston in a return stroke toward the retracted position shown in FIG. 1.

The end wall 42 of the cylinder is provided with pressure air passages for directing pressure air from a source to one end of the cylinder and, more particularly, to the left-hand end thereof as viewed in FIG. 1. Pressure air is supplied through a line 50 and the passages in the end wall include the passage 51 connecting to a lateral passage 52 leading to the cylinder and a bore 53 which opens centrally into an end of the cylinder.

The air-motor continually reciprocates so long as pressure air is supplied to the line 50. The structure of the air-hydraulic pump which has been described as well as the structure thereof causing automatic reciprocation is generally as shown in the previously mentioned McClocklin U.S. Pat. No. 3,597,121, assigned to the assignee of this application, and the disclosure thereof is incorporated herein by reference.

The piston has a control valve, in the form of valve means indicated generally at 60, movably associated with the piston 45 including a valve member 61 and an operating piston 62. The valve member 61 is shown in closed position in FIG. 1 against a valve seat 63. When the valve member 61 is open and at a distance from the valve seat 63, there is an air flow path between opposite sides of the piston 45 through piston passages 64 and 65. With the parts as positioned in FIG. 1, pressure air directed to the left-hand end of the cylinder 40 acts on the side of the piston adjacent the end wall 42 to move the piston toward the right against the action of the spring 47. As described in the McClocklin patent, as a peripheral seal 70 on the piston 45 moves beyond a bypass passage 71, formed on the interior of the wall of the cylinder wall 40, pressure air communicates with a chamber 75 within the piston which houses the operating piston 62 through a passage 76 to move the operating piston toward the left, as viewed in FIG. 1, and shift the valve member 61 to open position. As a result, pressure air can flow through the piston passages 64 and 65 and remove the pressure differential across the piston whereby the spring 47 can urge the piston 45 toward the left, as viewed in FIG. 1. The air passing through the piston 45 can exhaust from the right-hand end of the motor cylinder through a passage 80 and then exhaust to atmosphere through a muffler, indicated generally at 81.

As the piston 45 moves in its return stroke to the retracted position of FIG. 1, the valve member 61 will contact the end wall 42 of the cylinder to shift the valve member to closed position. During the return stroke of the piston, the valve member 61 has been maintained open by air trapped within the piston chamber 75. Shortly prior to reaching the retracted position, a piston seal 85 has moved to a position whereby the bypass passage 71 connects the piston passage 76 to the exhaust passage 80 whereby the operating piston is free to move to the right as the valve member 61 moves to closed position. With continued application of pressure air through line 50, the cycle of the motor and pump is repeated.

The foregoing structure and operation thereof is generally as described in the aforesaid McClocklin patent. In order to assist the valve member 61 remaining in open position as the piston 45 moves from extended to retracted position, a spring member 86 is positioned within the piston chamber 75 and yieldably urges the operating piston 62 to a position to maintain the valve member 61 in open position.

With the structure as described in commerical use, it has been found that the air-hydraulic pump is vulnerable to malfunction due to a rebounding of the piston 45 as it contacts the end wall 42 of the cylinder during the return stroke thereof. The rebounding causes a momentary pressure drop in the cylinder adjacent the end wall 42 at the beginning of the pumping stroke and movement of the piston 45 toward extended position. If the pressure drops to a sufficiently low value, there are sufficient forces which could cause the valve member 61 to open. These forces include residual air pressure trapped in the piston chamber 75, inertia, the force of spring 86, and release of stored energy in the valve member 61 which is formed of a material having some resiliency. If these forces should open the valve member 61 to a position other than fully-open, the valve member will act as an orifice as there is flow through the piston passages 65 and 65 to exhaust, which could result in the piston 45 balancing out because the air pressure acting on the left end thereof cannot overcome the return spring 47 and friction forces encountered by the piston 45. Additionally, the return spring 47 cannot overcome the air pressure and friction forces to return the piston 45 in a direction to reseat the control valve 61. As a result, the piston 45 can become stalled in an intermediate position.

In order to avoid possible malfunction, means are provided to maintain the valve member 61 closed as the piston 45 begins its movement in the pumping stroke and during any possible rebound of the piston at the end of the return stroke. This means comprises a resilient member in the form of a coil spring 90 positioned within the bore 53 of end wall 42 and having an end at the base of the bore secured to the end wall by a fastening member 91. The coil spring 90, when in inactive position, extends beyond the end wall 42 and is shown substantially fully compressed in FIG. 1 by contact with the valve member 61.

As the piston 45 moves to the retracted position, the valve member 61 engages the coil spring 90 to cause compression thereof whereby the coil spring 90 will apply a force against the valve member 61 to maintain it in closed position as the piston 45 moves away from the retracted position in a pumping stroke. The coil spring 90 is stiffer than the spring 86 within the piston chamber 75 to exert a greater force whereby the coil spring 90 acts to maintain the valve member 61 closed during an initial part of the pumping stroke of the piston 45 and avoid any possibility of the valve member 61 opening inadvertently during a rebounding of the piston 45.

We claim:

1. A hydraulic pump having a reciprocally-operable pumping member; a fluid motor including a cylinder containing a reciprocal piston movable between a retracted position at one end of the cylinder and an extended position and connected to said pumping member, a fluid inlet through which fluid under pressure may be admitted into said one end of the cylinder to drive the piston towards said extended position, spring means for driving the piston towards said retracted position, and a fluid outlet for exhausting fluid within the cylinder to permit the spring means to drive the piston towards said retracted position; a control valve in said piston alternately movable between a closed position wherein fluid under pressure from said fluid inlet drives said piston toward the extended position and an open position wherein said one end of the cylinder is connected through the piston to said fluid outlet to permit movement of the piston to said retracted position by said spring means to thereby reciprocate the pump member; control means responsive to the piston approaching the retracted position for shifting the control valve to the closed position and responsive to the piston in the extended position for shifting the control valve to the open position; means yieldably urging said control valve toward said open position including a spring member within the piston and engaging the control valve; means for positively holding said control valve in said open position when said piston is moving from said extended position thereof to said retracted position thereof; and resilient means engageable within the control valve to maintain the control valve closed during the initial movement of the piston away from said retracted position.

2. A pump as defined in claim 1 wherein said cylinder has an end wall with a bore, and said resilient means is a coil spring secured in said bore with one end extended outwardly of said bore for said contact with said control valve.

* * * * *